United States Patent [19]

Yamada

[11] Patent Number: 4,935,977

[45] Date of Patent: Jun. 26, 1990

[54] LEAF SPRING

[75] Inventor: Junji Yamada, Shatin, Hong Kong

[73] Assignee: Yamada Co., Ltd., Hong Kong

[21] Appl. No.: 205,678

[22] Filed: Jun. 12, 1988

Related U.S. Application Data

[63] Continuation-in-part of Ser. No. 148,126, Jan. 27, 1988, abandoned, which is a continuation of Ser. No. 734,093, May 15, 1985, abandoned.

[51] Int. Cl.[5] ..... A47C 23/08

[52] U.S. Cl. ..... 5/237; 5/446; 5/6; 267/148; 267/158; 267/47

[58] Field of Search ..... 5/6, 182, 191, 236 R, 5/237, 238, 446, 447; 207/47, 148, 149, 158, 160; 124/23 R

[56] References Cited

U.S. PATENT DOCUMENTS

| | | | |
|---|---|---|---|
| 389,292 | 9/1888 | Flohr | 5/237 |
| 2,638,606 | 5/1953 | Austin | 5/266 B |
| 2,815,015 | 12/1957 | De Giacomo | 124/23 R |
| 3,015,327 | 1/1962 | Lightcap | 124/23 R |
| 3,167,063 | 1/1965 | Kappas | 124/23 R |
| 3,280,515 | 10/1966 | Eriksson | 5/446 |
| 3,716,875 | 2/1973 | Fehr | 5/237 |
| 3,850,156 | 11/1974 | Eicholtz | 124/23 R |
| 4,468,014 | 8/1984 | Strong | 267/47 |
| 4,589,151 | 5/1986 | Behrens | 5/237 X |
| 4,688,778 | 8/1987 | Woltron | 267/148 |

FOREIGN PATENT DOCUMENTS

| | | | |
|---|---|---|---|
| 626838 | 5/1927 | France | 5/182 |
| 1253004 | 12/1960 | France | 5/237 |
| 55-100565 | 7/1980 | Japan . | |
| 600835 | 6/1978 | Switzerland | 5/191 |
| 2021731 | 12/1979 | United Kingdom | 267/149 |

*Primary Examiner*—Michael F. Trettel

*Attorney, Agent, or Firm*—Sandler, Greenblum & Bernstein

[57] ABSTRACT

A leaf spring includes a plate having a thickness of between approximately 5 mm and 20 mm, a width of between approximately 20 mm and 200 mm, and a given length. The plate is arcuately deformed so that it includes a central portion with a height of between 20 mm and 40 mm. The plate exhibits a predetermined resiliency for maintaining the plate in a substantially horizontal position under a load of between 5 kg and 30 kg and for preventing the plate from breaking under a load of between 50 kg and 100 kg. Further, the plate includes first and second layers made of glass-fiber or carbon-fiber and a core member made of a polyurethane foam material positioned between the first and second layers.

28 Claims, 10 Drawing Sheets

FIG. 9
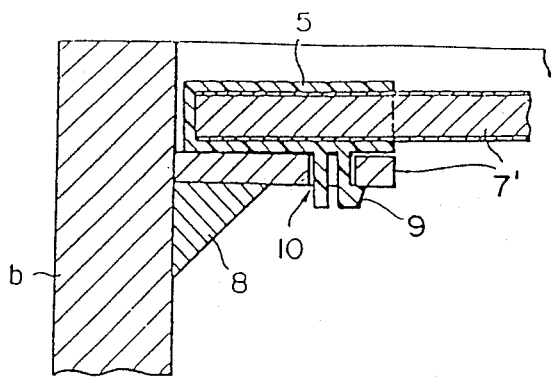
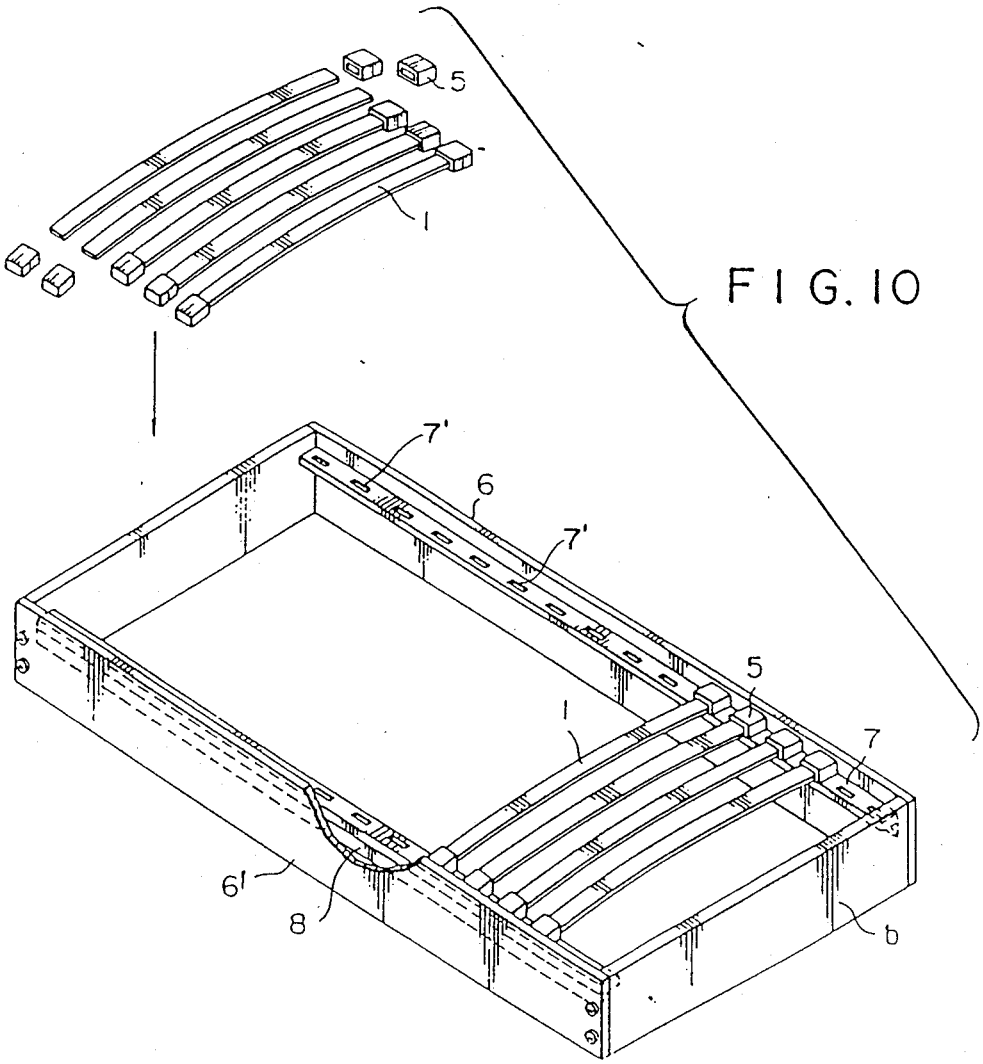
FIG. 10

LEAF SPRING

RELATED APPLICATIONS

This application is a continuation-in-part of U.S. patent application Ser. No. 148,126, filed January 27, 1988, now abandoned which is a continuation of Ser. No. 734,093, filed May 15, 1985, now abandoned, the disclosures of which are hereby incorporated by reference thereto into this application.

BACKGROUND OF THE INVENTION

1. Field of the Invention

This invention relates to a leaf spring for various industrial fields, and more particularly to a new type of leaf spring which is efficient in maintaining the health of the human body.

2. Description of Background and Material Information

Although various types of leaf springs are used in the machine industry including applications found in the furniture industry, there has been very little development of leaf springs designed to enhance or maintain human health. In the past, the natural power of leaf springs was primarily used to proide a comfortable feeling as a result of its resiliency. One example of such a conventional use of a leaf spring is Japanese Utility Model Laid-Open No. 55-100,565 (the Japanese Utility Model Application No. 53-182,991) which shows a plurality of sliced wooden plates overlapped to each other to cause their central parts to be bent into an arch form with fibre reinforced plastics (FRPs) covered on both upper and lower surfaces of the plates (hereinafter referred to as prior art). This prior art shows only a cross sectional shape of the plate, does not describe any physical property, and it is not possible to understand at all from the description whether the spring is practically applied, or if there is any relationship of the spring to the human body at all. This prior art does not appear to be actually applied practical technology.

Another use of the leaf spring is in bedding applications. Related to this, it is well known that the rational attitude of the human body during sleeping is near to the right attitude of the human body during standing. Notwithstanding this fact, however, the conventional type of beds for the most part include some coiled springs, which prevent a rational attitude of the human body from being obtained.

SUMMARY OF THE INVENTION

An object of the present invention is to eliminate the drawbacks and difficulties of conventional leaf springs.

It is, therefore, an object of the present invention to provide a leaf spring which is efficient in maintaining the health of the human body, and yet is durable and strong for extended use with minimal damage.

It is a more particular object of the present invention to provide a leaf spring which is used in a seat for a car or chair in a room in the automobile industry.

It is another particular object of the invention to provide a leaf spring for beds.

It is a further object of the present invention to provide a new type of leaf spring for bedding and for various chairs.

The above and other objects, features and advantages of the present invention will become more apparent from the following description and appended claims, taken in conjunction with the accompanying drawings, which show by way of non-limiting examples some preferred embodiments of the invention.

BRIEF DESCRIPTION OF THE DRAWINGS

FIGS. 9 to 12 are, respectively, a side elevational view with a part of the bed being broken away having the leaf spring of the present invention utilized therein, a side elevational view for showing the fixed and stored condition, and a side elevational view showing the stored condition;

DETAILED DESCRIPTION OF THE INVENTION

Figure 1:
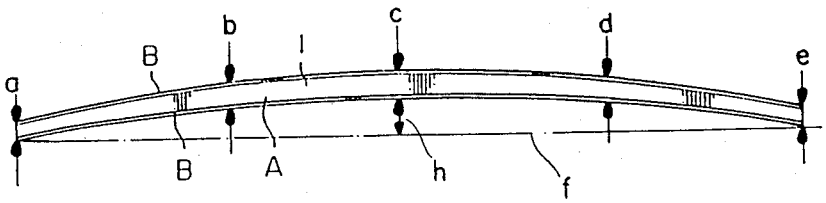
FIGS. 1 to 3 show a longitudinal front elevational view in section, a top plan view and a side elevational view of the leaf spring of the present invention, respectively.
Figure 2:
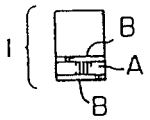
Figure 3:
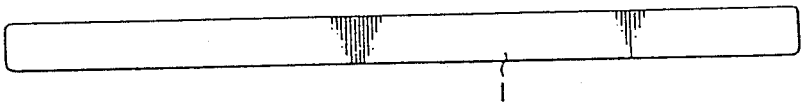
Figure 4:
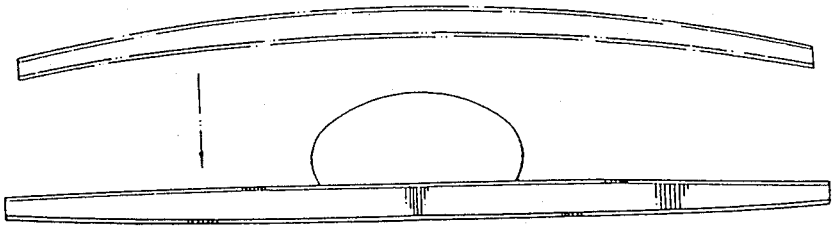
FIG. 4 shows a case in which a load is applied to the system shown in FIG. 1.

Referring to the drawings, the present invention will be described with respect to FIG. 1 which is a sectional view as an illustration of the basic concept of the present invention.

At first, an example in which the leaf spring of the basic invention will be described.

Figure 13:
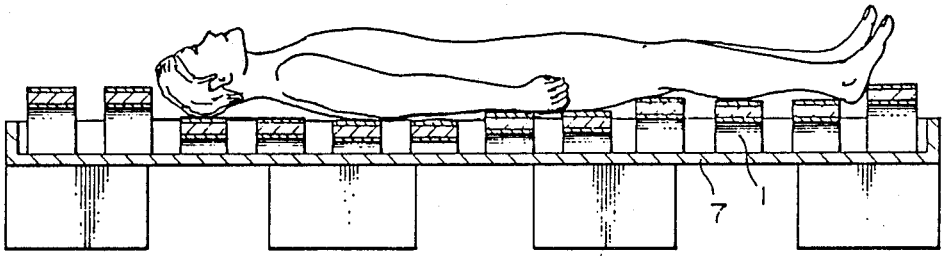
FIG. 13 is a perspective view showing the Japanese style room bed and also a longitudinal side elevational view in section for showing the condition of its use.
Figure 14:
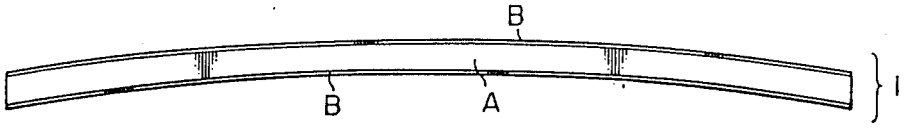
FIG. 14 is a longitudinal front elevational view in section showing a condition in which the leaf spring of the present invention is made to have the same thickness.

It is known that the rational or natural attitude of a sleeping person should duplicate the rational or natural standing attitude or posture of an erect person which is maintained for example as shown in FIG. 13.

When sleeping on a soft Japanese mattress or usual mattress, the heavier portions of the human body, such as the areas of the back and hip sink into the mattress, while the leg and feet portions are pushed up on the mattress imparting a V-shape form to the prone body, thereby resulting in a bad feeling during sleeping. This attitude of the body is far from the rational sleeping attitude wherein the heavier hip part should only sag into the mattress by about 20 to 30 mm. Therefore, it can be said that the weight of a hip occupies approximately 44% of the weight of the entire body. As one example, a person with a weight of 60 kg. will be illustrated when using one preferred embodiment of the present invention. Referring to FIG. 1, the sectional structure of the leaf spring in relation to its size for a single size bed is as follows.

| | |
|---|---|
| Length | 910 mm |
| Width | 50 mm |
| Total thickness of the plate | |
| Points a and e | 6 mm (at both sides) |
| Points b and d | 12 mm (intermediate points) |
| Point c | 15.2 mm (central part) |

A height of curve (h) is 25 mm counted from the central point of a line (f) connecting both ends.

The total weight is 364 g.

A core member (A) of the leaf spring is made of wood, and other materials of urethane-foam, such as polyurethane, or the honeycomb structure of other well-known filling materials can be applied to the wooden core member.

Although FRP is mainly applied as a reinforcing member (B) for the core member (A) of the leaf spring, other materials having qualities similar to those of these materials can be used. One thickness of FRP as used here is 0.5 mm, although the other thicknesses may optionally be selected as required.

The FRP as used herein is a laminated layer of epoxy resin, unsaturated polyester and glass-fiber. Other plates having some resins immersed in glass-fiber and applied with heat and pressure can be used, in addition to other resins, such as epoxy resin, diallylphthalate resin and unsaturated polyester resin and the like. Although glass-fiber is mainly used, a carbon-fiber may be used in place of the glass fiber.

Figure 34:
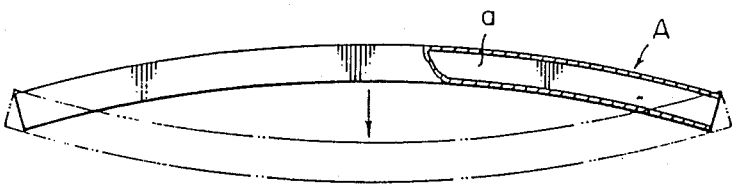
FIGS. 34 and 35 are views showing a metallic leaf spring.
Figure 35:
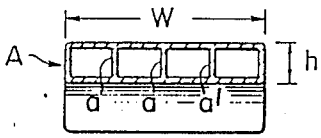

Assembly of the core member (A) and the reinforcing member (B) is made such that, for example, in case of a wooden core member (A) and FRP reinforcing members (B), the core member and the reinforcing member are integrally assembled with adhesive agents. Alternatively, in case of a urethane-foam core member (A) and FRP reinforcing member (B), the reinforcing members (B) are attached to the upper and lower inner parts of the mold, and urethane-foam liquid is poured between the upper and lower parts until the space therebetween is filled and then the urethane-foam is permitted to solidify to make an integral assembly with the reinforcing member, after which the assembled body is removed from the mold. Alternatively, a metallic element may also be used in which case, in order to have a spring characteristic as shown in FIGS. 34 to 35, it will be necessary for it to have an irregular section.

Figure 32:
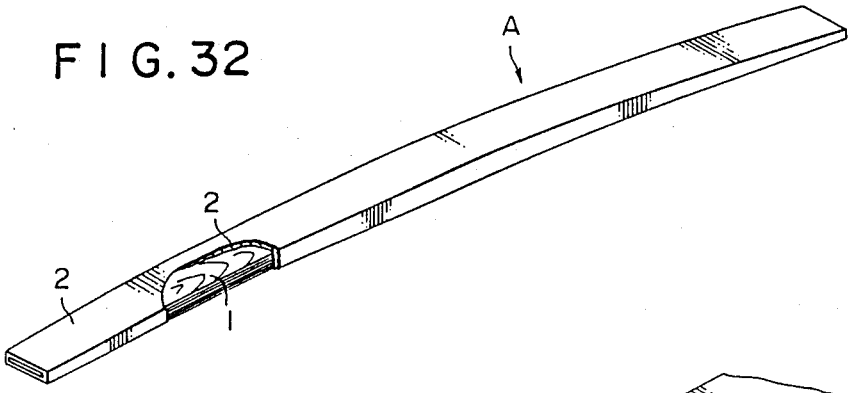
FIGS. 32 and 33 are perspective views showing a condition in which a thermal shrinkage synthetic resin film covers a leaf spring of the present invention.
Figure 33:
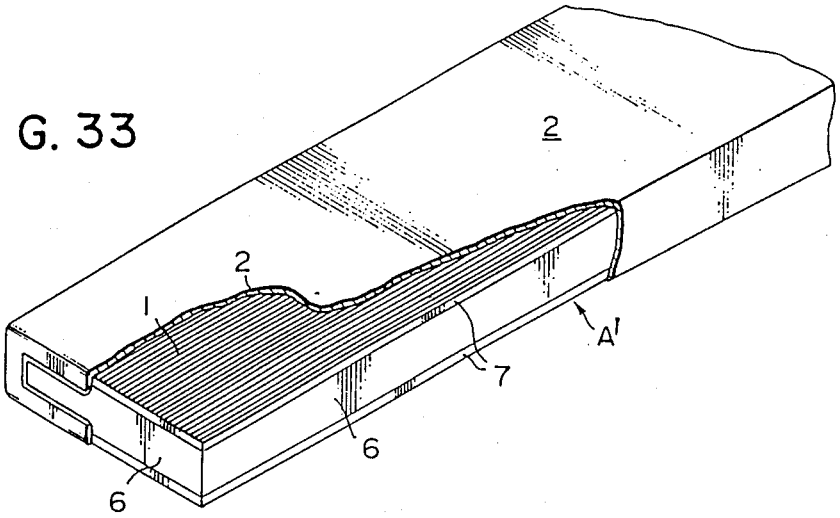

In order to improve a practical feature of the leaf spring of the present invention, as shown in FIGS. 32 and 33, the overall leaf spring of the present invention may be covered by a thermal shrinking synthetic resin film of bag form using connectors at both ends, as shown in FIGS. 9 to 12, to increase the durability in use of the leaf spring of the present invention.

The synthetic resin film used for the present invention is a thermal shrinking synthetic resin having a thickness of about 1 mm, a relatively hard surface, and an anti-scoring feature. In order to adhere the film to the surface of the leaf spring (1), the film is formed as a tubular shape having substantially the same length as that of the leaf spring (1), and an inner circumferential length slightly larger than an outer circumferential length of the leaf spring (1). The leaf spring (1) is then inserted into the tube, and hot water is splashed over the tube to shrink the film and cause the film to be adhered to the surface of the leaf spring (1). The film at both ends is adhered to the end surfaces of the leaf spring (1) while being inserted therein so as to prevent the film from being peeled off the leaf spring.

Equations for the numerical calculation of the leaf spring of the present invention is described herein below based on the assumption, that the weight of a human body is 60 kg and the weight of the hip area is 44% thereof, or little over 26 kg. In this case where the area of the hip part is 314 $cm^2$, this area can be calculated to have a weight of a little over 26 kg. Thus, the strength of the leaf spring can be calculated in response to how many leaf springs accept the weight and the area, i.e., how many leaf springs are needed.

For example, if a load weighing a little over 26 kg. is supported by two leaf springs, one leaf spring may accept the load of 13.5 kg, if the load is supported by four leaf springs, one leaf spring may accept a load of a little over 6 kg, and if the load is supported by six leaf springs, one leaf spring may accept a load of 4.4 kg.

Examples of two leaf springs, for example as shown in FIGS. 15 to 18 supporting the load of 13.5 kg. in their calculation will be described hereinbelow.

1. Center line

In view of the rational sleeping attitude, a sinking of 2.5 cm is the most preferable value for a point loading of 13.5 kg, so that this load corresponds to the weight at the hip part of the sleeping attitude.

Figure 15:
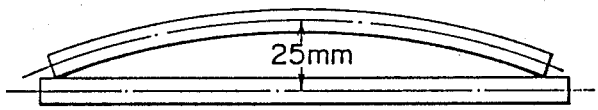
FIGS. 15 to 25 illustrate are views showing the calculations made to determine the characteristics of the leaf springs used.
Figure 16:
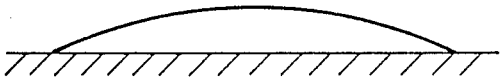

It is desired that the center line of thickness of the leaf spring will become horizontal when a sinking of 2.5 cm occurs, as illustrated in FIG. 15.

2. Plate thickness

The plate thickness and plate shape should be selected by seeking the rational leaf spring, not by assuming, in advance, a plate thickness which is the most suitable value with respect to a full length.

3. Abstract of calculation (a) Assumption of the abstract of matters described above:

Calculation of the leaf spring.
Sandwiched structure.
The surface material is FRP.
Shape of ⌒ .

(b) Assumption in calculation

Figure 17:
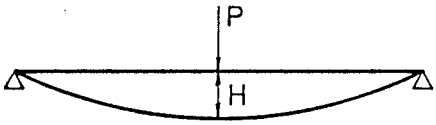

Load: P
Length: l
Width of leaf spring: W
Thickness of the surface material: T
Maximum flexure: H
Number of divisions of the leaf spring in its longitudinal direction: n (c) Calculation is performed to define what curve is the best for the center line of the leaf spring, as illustrated in FIG. 17.

Figure 18:
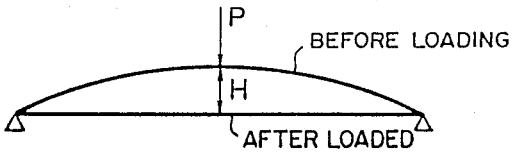

When the flexure curve of the spring is applied in advance as a bend before applying a load upwardly, the leaf spring may flex after loading by a value of H, and then the entire spring becomes flat, as illustrated in FIG. 18. A calculation thus is performed to define a radius of curvature under a flexure of H, to thereby define what clearance (bend) of the portion other than a central part is the best.

(d) A second moment of area (I) is calculated in order to define the thickness of each of the portions. The value I has a defined value in response to a shape and size of the section. In other words, when the value I is defined, a definition of the shape (rectangular) and a part of the size (width) allows the thickness to be defined.

(e) In case of a single element, a definition of the second moment of area of the element will define the thickness; and in this case, since the leaf spring has a sandwiched structure, it is necessary to calculate the thickness of the core and the thickness of the surface material separately. If the thickness of the surface material is constant, the thickness of the core member can be defined.

On the other hand, it is not possible to calculate uniformly the thickness of the core member in response to the equation of the second moment of area of the strength of materials in the case of sandwiched structures. Due to this fact, the thickness of the core member should be defined by solving a cubic equation or repeating the calculation.

(f) A rational plate thickness is then calculated up to the previous step.

The maximum load and the flexure in case of rupture are calculated in order to display the quality of the product, and flexure and "stress" are calculated in response to the thickness to confirm whether the initial performance will be assured with respect to the thickness of each of the defined portions, and then it will be described.

Method of Calculation

Figure 19:
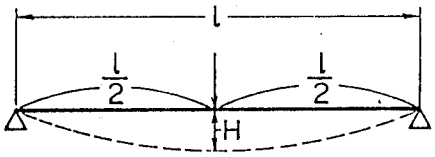

1. Calculation of radius of curvature:

A centered concentration load is applied to the plate shown in FIG. 19. That is, if a force is applied to the center of the leaf spring or "beam", a flexure H will be produced. The leaf spring at this time shows a shape indicated by a straight line to be the curved shape shown by a dotted line.

The curve shown by this dotted line forms a part of the circle. The radius of this circle is called a "radius of curvature".

Figure 20:
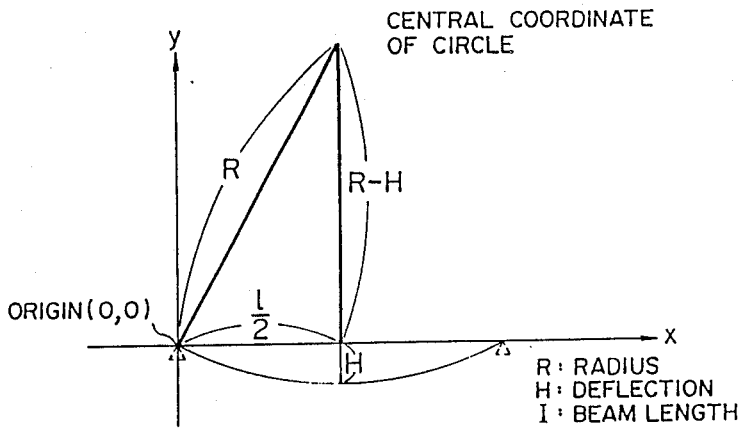

A radius of curvature R in case of the flexure of H is then calculated. If the length of the leaf spring is defined as l, the following relation can can be attained, as illustrated in FIG. 20.

A general equation of a circle is define as follows:

$$(X-a)^2+(Y-b)^2=R^2 \qquad 1$$

This means that a central coordinate is located at a point (a,b).

Referring now to FIG. 20:

$$a = l/2 \qquad 2$$
$$b = R - H$$

When these values are substituted in equation 1, above then $$(X-l/2)^2+(Y-(R-H))^2=R^2.$$

Since this circle passes through an origin (0,0), then $$(0-l/2)^2+(0-(R-H))^2=R^2$$

$$(-l/2)^2+(-(R-H))^2=R^2$$

$$l^2/4+(R-H)^2=R^2$$

$$l^2/4+R^2-2RH+H^2=R^2.$$

Subtraction of $R^2$ from both sides and transposition of 2RH to the right side result in the following equation:

$$l^2/4+H^2=2RH$$

$$R=\tfrac{1}{2}H\,(l^2/4+H^2) \qquad 3$$

That is, the radius of curvature R can be defined if the strain H and the length of l are determined.

2. Relation between the position and the bend:

A curve formed under a deformation of the beam by flexure forms a part of a circle and then a radius of curvature is defined.

Figure 21:
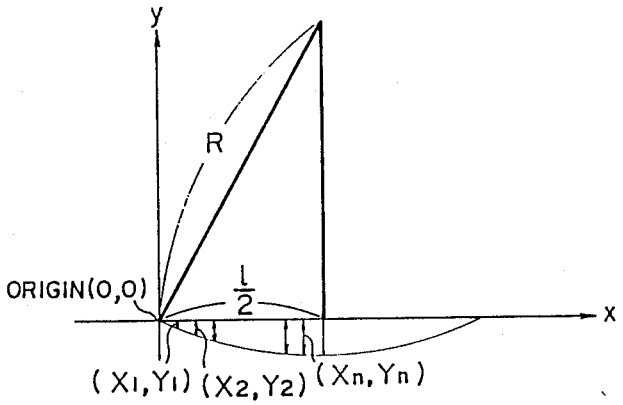

With this calculation, the flexure at each of the points in the leaf spring is calculated, as illustrated drawing is FIG. 21.

Based on equation 1, the equation of a circle is as follows:

$$(X-a)^2+(Y-b)^2=R^2.$$

Applying this equation, the flexure of Y is calculated.

Conditions: $Y\ 0$ (part below X axis is calculated.)
$0 \times l/2$ (since the shape caused by the flexure shows a symmetrical shape at a half ($l/2$) of the entire length, calculation of the half is sufficient.

In turn, from the equation 2, it is already found that $$a = l/2$$
$$b = R - H$$

Then, it must be decided how many equally-spaced sections are defined in a range from an origin (0,0) to $X=l/2$, that is how many flexures are calculated. X(i) and Y(i) when the equally divided number is defined as "n" are calculated as follows:

$X(i)$: $i = 1$ to $n$, coordinate of X-axis in i-th order
$Y(i)$: $i = 1$ to $n$, coordinate of Y-axis in i-th order-flexure Calculated range of $X$ is $X = l/2 - 0$
$X = l/2$ in reference to a relation of $0 \times l/2$.

When the length l/2 of X is equally divided by n, one section of the divided length becomes $$l/2+n=l/2n$$

Therefore, i-th item of X becomes $$X(i)=l/2n\times i \qquad 4$$

In this equation, all the items except Y are already known which constitute the equation 1 (equation of the circle).

Therefore, the equation 1 is expressed as $$Y= \ldots$$

Y, i.e., Y(i) can be calculated from the elements of the right hand side.

Then, the equation 1 is modified, resulting in the following equations:

$$(X-a)^2+(Y-B)^2=R^2$$

$$(Y-b)^2=R^2-(X-a)^2$$

Extracting the square roots of both sides results in a calculation that:

$$Y-b=\pm\sqrt{R^2-(X-a)^2}$$

$$Y=\pm\sqrt{R^2-(X-a)^2}+b \quad 5$$

In reference to the condition here, i.e., as shown in FIG. 20 where $Y\leqq 0$, there is a relation of $B>0$, so equation 5 becomes:

$$Y=-R^2-(X-a)^2+b \quad 6$$

Substituting X and Y with X(i) and Y(i), respectively, resulting in the following equation:

$$Y(i)=-R^2-(X(i)-a)^2+b \quad 7$$

further, the item Y(i) comprises only items H, n and i in view of the following equations, i.e.:

$$R = 1/2\ H(l^2/4 + H^2) \quad \text{(From equation 3)}$$
$$X(i) = l/2n \times 1$$
$$a = l/2$$
$$b = R - H$$
$$b = 1/2\ H\ (l^2/4 + H^2)$$

Figure 22:
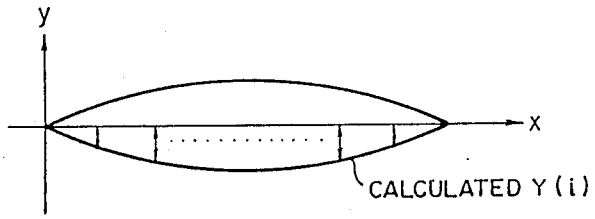

Since all these variables are already known or given, they may easily be calculated, as illustrated in FIG. 22.

The calculated value of Y(i) is a flexure of a horizontal leaf spring. Therefore, if it is desired to have a horizontal leaf spring under loaded conditions, the flexure of Y is applied as a relation of $Y\geqq 0$ before loading in advance, resulting in the desired horizontal condition.

Therefore, this means that the calculation can be performed under a condition such that a bend height of $YB(i)=-Y(i)$ . . . 8 is attained.

3. The second moment of area for each of the parts will be calculated.

Then, a plate thickness of each of the parts of which the bend is made in the previous step is calculated.

In order to calculate the plate thickness, the second moment of section of each of the parts is similarly calculated.

In the case of supporting at both ends the central concentrated load, the second moment of section Di for each of the parts (Xi) can be expressed as follows:

$$D_i=P/48EsYi\ [3\ ^2X_i-4X^2_i] \quad 9$$

Thus, it is assumed that the second moment of area is defined as $$I=ax+b \quad 10$$

wherein the coefficients a and b are defined from the conditions of:

(1) thickness at the end part, and (2) loading conditions at the central part.

Substituting the second moment of section $I=ax+b$ for the differential equation of $$d^2y/dx^2=M/EI \quad 11$$

differentiating it; and introducing the calculating equation of flexure with the result in that $$A = P/2aE\ c = b/a \quad 12$$
$$Y_i = -A[x^2/2 - c(x + c)\log(x + c) + (c + K_1)x + K_2] \quad 13$$

A flexure at any position can be calculated in reference to the above equation.

Figure 23:
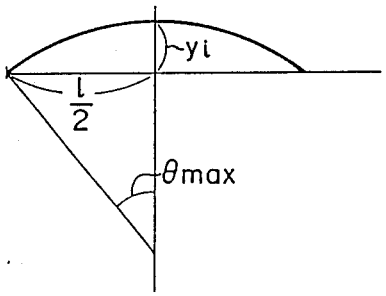

Referring now to FIG. 23, a second moment of section at each of the plate thicknesses can be calculated as follows:

This means that equation 9 is applied for the horizontal leaf spring, the leaf spring is supported by both ends thereof, and the second moment of area at the central concentrated load is calculated, so that a correction is required for the upward directed moment.

If it is assumed that a maximum angle is defined as $\theta_{max}$, then $$\sin(\theta_{max}) = \frac{l/2}{R} = l/2R$$
$$*\max = \sin^{-1}/2R$$

Figure 24:
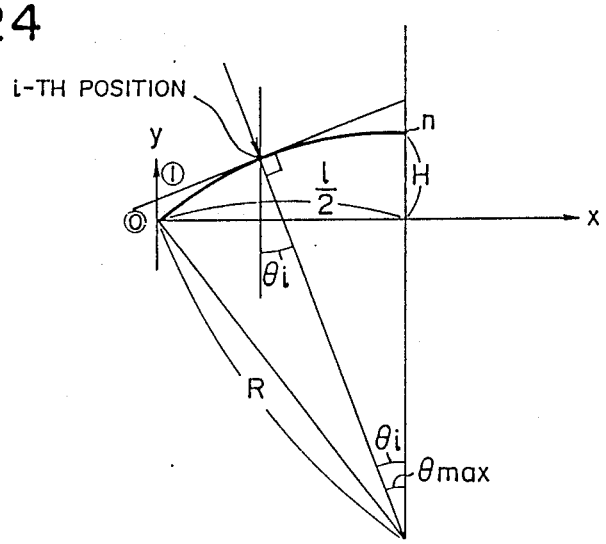

An angle $\theta_i$ of the i-th order of the divided numbers n, as illustrated in FIG. 24, is defined as $$\theta_i=\theta_{max}^2\ (1-1/n)$$

In turn, the second moment of the section indicated by the equation 9 at the i-th position is a moment perpendicular to the tangential point. Thus, it is necessary to correct the moment in a direction of X=(a line which is horizontal to axis Y) passing through the position of i.

If it is assumed that the coefficient of correction for the moment is $K_i$, in which $K_i=\cos 0_i$ can be attained and the corrected second moment of section (SKi) becomes as follows:

$$DK_i=D_1\times K_i^2=P/48EsYi\ (3\ 3X_i-4X_i^2)\times K_i^2 \quad 14$$

Figure 25:
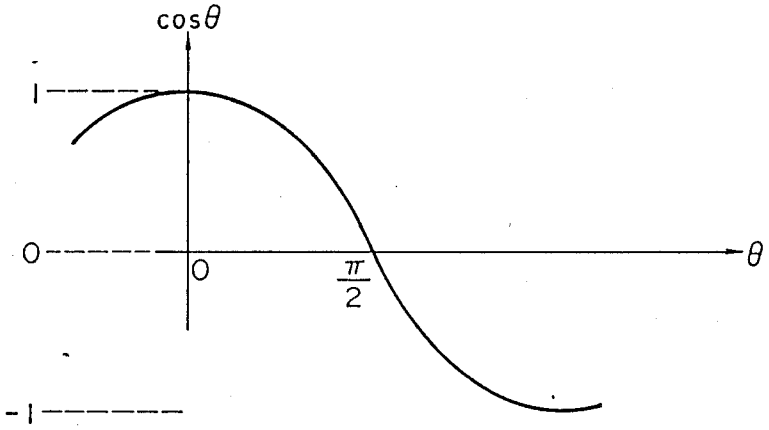
Figure 26:
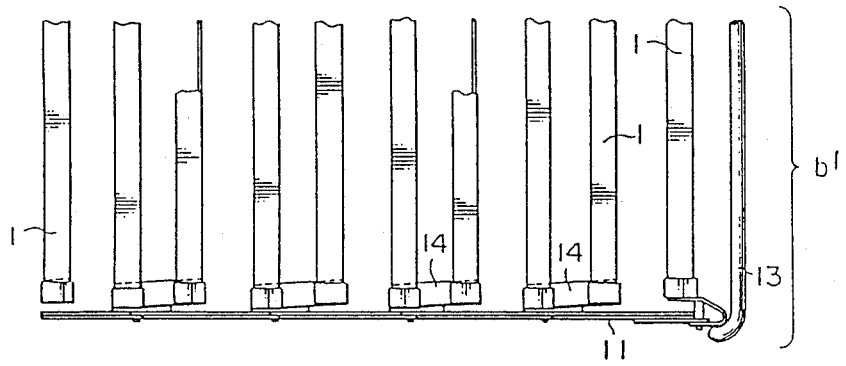
FIGS. 26 to 29 are views showing the condition in which the leaf spring of the present invention is utilized in an expandable and retractable bed.
Figure 27:
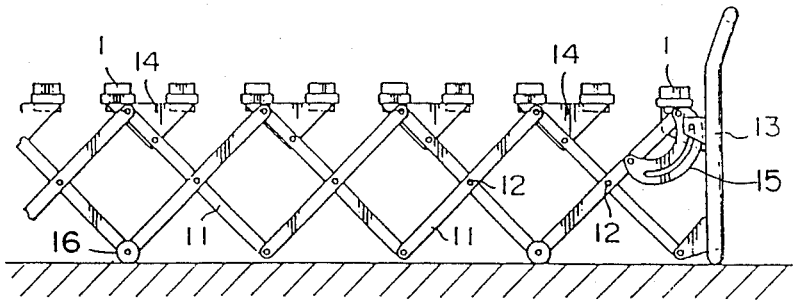

The value of $K_i$ will be studied now, referring to FIG. 24. The value of $\theta_i$ fulfills the following relationship:

$$\theta\leqq i\ \leqq\theta_{max}$$

and further the relation of $\theta_{max}<90°=\pi/2$ will be fulfilled, which may result in the following relationship:

$$\theta\leqq\theta_i\leqq\pi/2$$

in which the cos-function may describe a curve as shown in FIG. 25.

4. Analysis of the second moment of area:

The second moment of area that we now obtain is that for a plate having a total thickness made up of each of the parts of the core member and having the thickness of the surface member kept constant.

However, the second moment of area as indicated in equation 10 corresponds to the total thickness of the surface material and the core member.

Therefore, it is necessary to calculate the second moment of area for the surface material and the core member, separately.

Thus, it is defined that if the second moment of area of the surface material: $I_S$, the second moment of the area of the core member: $I_E$, and the second moment of the area of leaf spring: $I_T$ are arranged in a sandwiched structure, they may show the following relationship:

$$I_T = I_s + I_E \quad (15)$$

in which the second moment of area I for a leaf spring having a width b and a thickness t and being made from the same material is defined as $$I = 2_o \int^{T/2} X^2 b dx = 1/12\, bt^3 \quad (16)$$

and this value may be expressed as $$I = 1/12\, bt^3 \quad (17)$$

If the leaf spring has a core member. The thickness t is defined as $$t - TT - 2T$$

where

TT: total thickness of the leaf spring

T: thickness of the surface material and the coefficient $\alpha$ can be defined as follows, $$\alpha = \frac{\text{elastic modulus of core member}}{\text{elastic modulus of surface material}} (E_c/E_s)$$

as an example, $E_c$ is 100 kg/mm$^2$ for urethane and $E_s$ is 3900 kg/mm$^2$ for glass-fiber. Therefore the second moment of area $I_E$ can be defined as follows:

$$\begin{aligned} I_E &= 1/12\, bt^3 \\ &= 1/12\, b \times (TT - 2T)^3 \times (E_c/E_s) \\ &= 1/12\, E_c/E_s\, (TT - 2T)^3 \end{aligned}$$

Similarly, the second moment of area of the surface material $I_S$ can be now defined.

First, it is assumed that the entire thickness TT is that of the surface material. Then, $I_S$ can be calculated by subtracting the second moment of area corresponding to the thickness of the core member.

Therefore, $$\begin{aligned} I_s &= \text{second moment of area of the surface material} \\ &= (\text{second moment of area of total thickness}) - \\ &\quad (\text{second moment of area of core member}) \end{aligned}$$

Substituting this value from equation 16 gives the following equation:

$$\begin{aligned} &= 1/12\, bTT^3 - 1/12\, b\,(TT - 2T)^3 \\ &= b/12\, TT^3 - b/12\,(TT - 2T)^3; \end{aligned}$$

and, then by arranging the equation with respect to b/12x, the following equation, is derived $$= b/12\,(TT^3 - (TT - 2T)^3) \quad (19)$$

The equations for $I_E$ and $I_S$ are defined and the thicknesses of the surface material and the core member are arrived at in accordance with the following process.

5. Calculation of the plate thickness

The following values are already known as predetermined factors:

| | |
|---|---|
| Thickness of the surface material | T |
| Width of the leaf spring | b |
| Elastic modulus of the core member | $E_c$ |
| Elastic modulus of the surface material | $E_s$ |
| Then, the following symbols are applied | |
| Incremental change in plate thickness | C |
| Plate thickness | TT |
| Second moment of area of the core member | $I_E$ |
| Second moment of area of the surface material | $I_s$ |
| Second moment of the area of the leaf spring | $I_T$ |

In reference to each of TTs, the values of $I_E$ and $I_s$ are calculated and then the value of $I_T$ is calculated by applying the equation $I_T = I_S + I_E$. If the calculated value of $I_T$ is not equal to the value calculated in equation 9, the value of TT is varied and an additional calculation is performed. When the value becomes equal to the value calculated in equation 9, the value of TT at that time determines the plate thickness of the i-th position of the leaf spring.

This calculation as described above can be expressed in a flow chart as illustrated in Table-1 below.

TABLE NO. 1

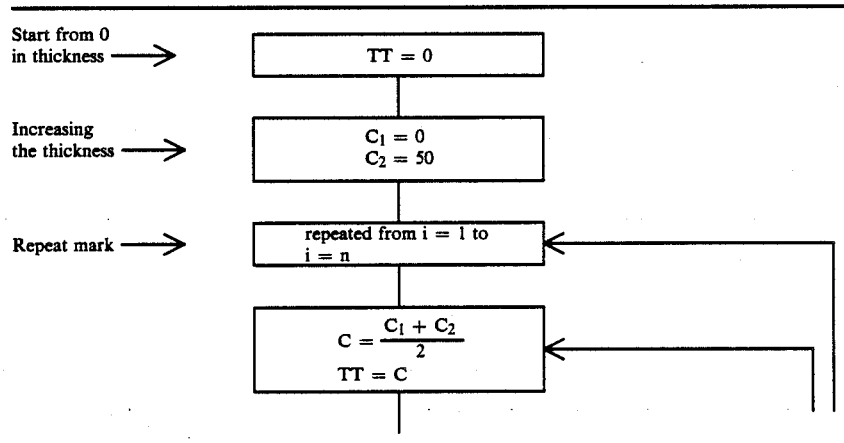

TABLE NO. 1-continued

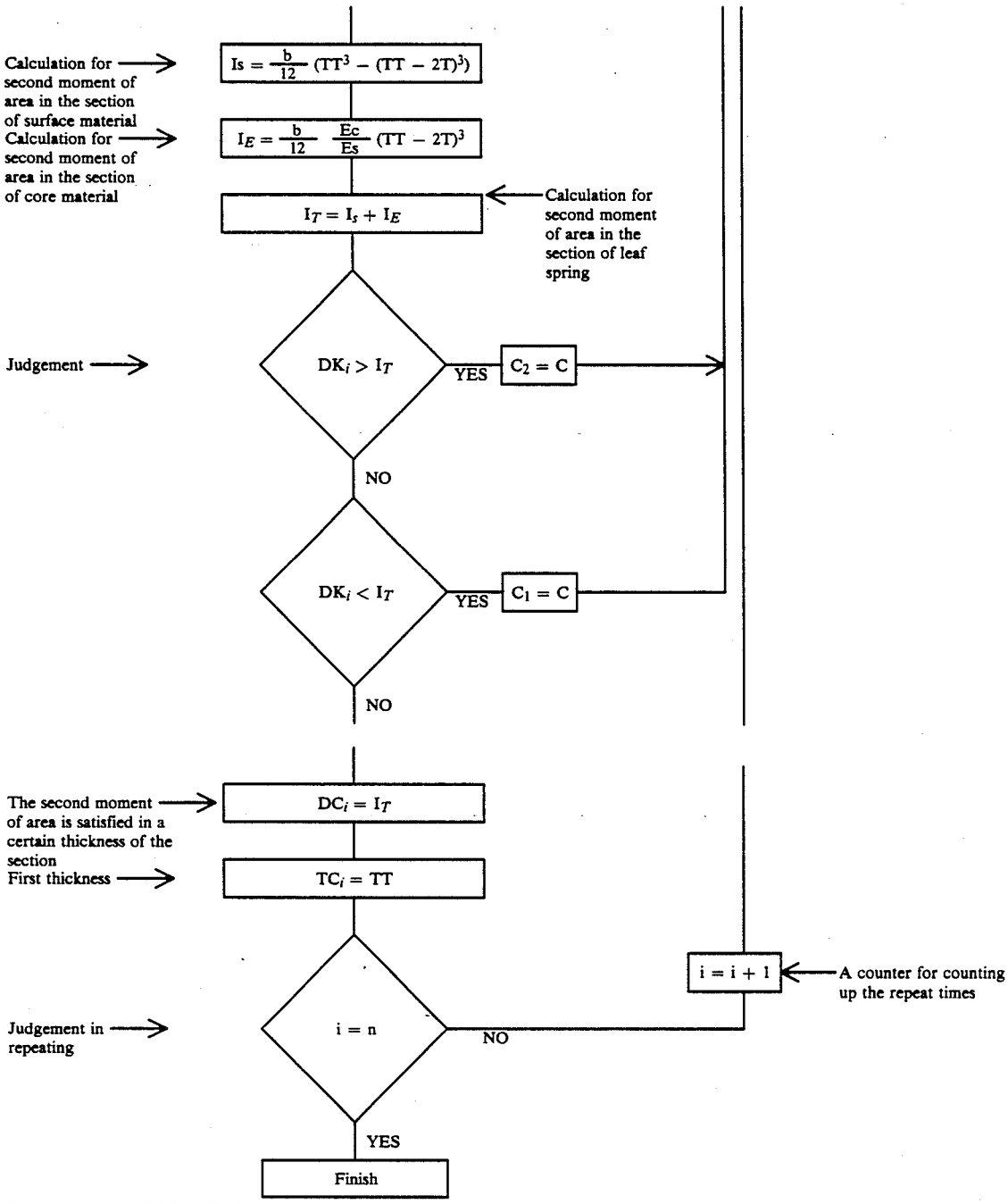

6. Calculation of performance of product

In the above steps, a process for calculating a rational plate thickness has been described. In this section a calculation is described for determining how a leaf spring will perform in reference to the calculated plate thickness.

| | Result of Output |
|---|---|
| Second moment of area | $I_T$ |
| Section modulus of leaf spring | $Z_T$ |
| Flexure | YY (DEF.) |
| Stress | SL (STRESS) |
| Maximum load | PM (MAX. LOAD) |

-continued

| | Result of Output |
|---|---|
| Flexure in case of breakage | EY (MAX. DEF) |

(b) Section modulus of leaf spring

The section modulus of leaf spring made of a uniform material and having a rectangular shape with a width of b and a thickness of t is expressed as:

$$Z = 1/6\ bt^2$$

When section moduli for each of the surface material, core member and leaf spring, are defined as:

Section modulus of the surface material: $Z_S$

Section modulus of the core member: $Z_E$

Section modulus of the leaf spring: $Z_T$ then the relationship $$Z_T = Z_S + Z_E \quad (21)$$

can be applied for a sandwiched structure. When the leaf spring is used having a core, the general equation of the section modulus of the leaf spring as indicated the equation 20 becomes:

core:

$$ZE = 1/6\ bt^2 Y \quad (22)$$

Where, t is expressed as $$t = TT - 2T$$

TT: total thickness of the leaf spring

T: thickness of the surface material and the coefficient $\gamma$ can be expressed as follows.

$$\gamma = \frac{\text{Strength of the core member}}{\text{Strength of the surface material}} = S_c/S_s$$

as an example $S_C$ for urethane is 3.4 kg/mm$^2$. (specific weight P=0.7) and $S_s$ for FRP. is 100 kg/mm$^2$. Thus, the section modulus $Z_E$ of the core member can be expressed as follows:

$$\begin{aligned} Z_E &= 1/6\ bt^2\gamma \\ &= -b(TT-2T)^2\, S_c/S_s \\ &= b/6\, S_c/S_s\,(TT-2T)^2 \end{aligned} \quad (23)$$

In turn, the section modulus $Z_S$ of the surface material is calculated as follows.

First, a total thickness TT of a surface material is assumed and a calculation of $Z_e$ is performed based on this assumption. Subsequently, the value of $Z_S$ can be attained by subtracting the section modulus corresponding to the thickness of the core member in reference to the result of the above-mentioned calculation which utilized the assumed value for TT.

Therefore, the value of $Z_s$ can be expressed as follows:

$$\begin{aligned} Z_s &= \text{Section modulus of the surface material} \\ &= (\text{Section modulus of total thickness}) - \\ &\quad (\text{Section modulus of the core member}) \end{aligned}$$

Substituting this value into equation 20 results the following relationship:

$$\begin{aligned} Z_s &= 1/6\ bTT^2 - 1/6\ b(TT-2T)^2 \\ &= b/6TT^2 - b/6(TT-2T)^2 \end{aligned}$$

Arranging this equation results in the following equation:

$$Z_S = b/6\,(TT^2 - (TT-2T)^2) \quad (24)$$

In reference to this equation, the section modulus of the leaf spring $Z_T$ can be expressed as follows in view of equations 21, 23 and 24:

$$\begin{aligned} Z_T &= Z_E + Z_S \\ &= b/6\ S_c/S_s(TT-2T)^2 + (TT^2 - (TT-2T)^2) \end{aligned} \quad (25)$$

(c) Flexure

The flexure at each of the portions can be calculated in the following equation.

$$YY_1 = -A\ [X^2/2 - C(X+C)\log(X+C) + (C+K_1)X + K_2] \quad (26)$$

where, $A = P/2aE$ $C = b/a$ (d) Calculation of stress

Stress at each of the portions can be expressed as follows.

$$SLi = PX/2Z \quad (27)$$

where, $Z = ax + b$, then the value of SLi can be expressed as follows, $$SLi = \frac{P \cdot X}{2(ax+b)} \quad (28)$$

In turn, since the maximum load PM is applied at the central part of the length of the leaf spring, substituting X=1/2 in equation 27 and replacing SLi with SLn, and P with PM, results in the following equation:

$$PM = \frac{2SLn(ax+b)}{X}$$

A flexure EY in case of breakage is calculated by substituting A=PM/2aE and X=in equation 26. The value of EY is calculated as follows:

$$EY = -A[l^2/B - c(l/2+c-)\log(l/2+C) + (C+K_1)l/2 + K_2]$$

As described above, the inventor has devised an equation of calculation for a quite new bedding, etc., which is not found in any prior art and which has been successful providing a quite useful leaf spring resulting from utilization of the new equation.

Practical examples of the leaf spring are indicated by utilizing the above-mentioned equation.

The above design considerations were applied in constructing both single size (width=910 mm) and semi-double size (width=1203 mm) bed springs. In order to meet the above design considerations and, at the same time, reduce the overall weight of the springs, the material utilized for the laminated layer was either carbon-fiber (elastic modulus (E)=10,000 Kg/mm$^2$) or glass-fiber (elastic modulus (E)=3,900 Kg/mm$^2$ or 4,480 Kg/mm$^2$). In addition, the core material was polyurethane foam having a density of either 35 Kg/m$^3$ or 45 Kg/m$^3$. For purposes of this disclosure, the values for elastic modulus and foam density define the extreme points including the ranges there between. Examples and characteristics of various single size and semi-double size bed springs are shown in Table 2 below.

TABLE 2

| SPRING | 1 | 2 | 3 | 4 | 5 | 6 | 7 | 8 |
|---|---|---|---|---|---|---|---|---|
| SIZE | SING | SEMI | SING | SEMI | SING | SEMI | SING | SEMI |
| LOAD | 13.5 | 13.5 | 13.5 | 13.5 | 13.5 | 13.5 | 13.5 | 13.5 |
| SPAN | 910 | 1203 | 910 | 1203 | 910 | 1203 | 910 | 1203 |
| MAX. DEF. | 25 | 25 | 25 | 25 | 25 | 25 | 25 | 25 |
| WIDTH | 50 | 49 | 50 | 49 | 50 | 49 | 50 | 49 |
| THICK (end) | 6.0 | 5.2 | 6.0 | 5.2 | 6.0 | 5.2 | 6.0 | 5.2 |
| E (skin) | 3900 | 3900 | 4480 | 4480 | 10000 | 10000 | 10000 | 10000 |
| S (skin) | 100 | 100 | 137 | 137 | 180 | 180 | 180 | 180 |
| DENS (skin) | 1.8 | 1.8 | 1.98 | 1.98 | 1.7 | 1.7 | 1.7 | 1.7 |
| THICK (skin) | .5 | .5 | .8 | .8 | .5 | .5 | .5 | .5 |
| E (core) | 52.5 | 52.5 | 36.5 | 36 | 36 | 36 | 52.5 | 52.5 |
| S (core) | 2 | 2 | 1.2 | 1.2 | 1.2 | 1.2 | 2 | 2 |
| DENS (core) | 45 | 45 | 35 | 35 | 35 | 35 | 45 | 45 |

DEFINITIONS

| | | |
|---|---|---|
| SING | Single size bed spring (width = 910 mm) | |
| SEMI | Semi-double size bed spring (width = 1203 mm) | |
| LOAD | Load on the spring | Kg |
| SPAN | Length of spring | mm |
| MAX. DEF. | Maximum deflection with load | mm |
| WIDTH | Width of spring | mm |
| THICK (end) | Thickness of end portion of spring | mm |
| E (skin) | Elastic modulus of skin layer | $Kg/mm^2$ |
| S (skin) | Strength of skin layer | $Kg/mm^2$ |
| DENS (skin) | Density of skin layer | $Kg/m^3$ |
| THICK (skin) | Thickness of skin layer | mm |
| E (core) | Elastic modulus of core | $Kg/mm^2$ |
| S (core) | Strength of core | $Kg/mm^2$ |
| DENS (core) | Density of core | $Kg/m^3$ |

Utilizing the above materials, the weights of the constructed springs are shown in Table 3 below.

TABLE 3

| SPRING | SKIN WT. (g) | CORE WT. (g) | TOTAL SPRING WT. (g) |
|---|---|---|---|
| 1 | 81.9 | 215.089 | 296.990 |
| 2 | 106.1 | 415.400 | 521.504 |
| 3 | 144.1 | 121.508 | 265.652 |
| 4 | 186.7 | 238.499 | 425.244 |
| 5 | 186.7 | 238.499 | 425.244 |
| 6 | 77.3 | 110.8 | 188.2 |
| 7 | 100.2 | 209.7 | 309.9 |
| 8 | 77.3 | 142.1 | 219.4 |
| 9 | 100.2 | 268.8 | 369.1 |

Practical examples in which the product of the present invention having the above-mentioned physical properties as used in a bed, chair or Japanese mattress will now be described.

When the present invention is utilized in a Japanese mattress, as shown in FIGS. 5 to 8, two clothes (a) and (a') are overlapped on each other, with the lower cloth (a) being provided with several openings (2) which form bag-like storing chambers (3). The leaf springs (1) of the present invention are inserted and stored in each of the bag-like storing chambers (3). Further utilization of the present invention includes a system in which an upper sheet (4) composed of urethane foam is placed on these leaf springs (1).

When the present invention is utilized in a stationary bed, as shown in FIGS. 9 to 12, the leaf springs (1) of the present invention are connected directly or via connectors (5) to the base (b) of the bed. The manner in which the connectors (5) are utilized is described in detail as follows.

Figure 12:
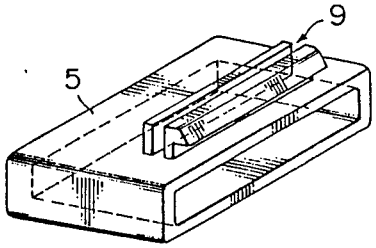

Support parts (7) which are used in supporting both ends of the leaf springs are arranged on the inner upper parts of the right and left side plates (6) and (6') of the base of the bed (b), along the side plates (6) and (6'). The supporting parts (7) are made such that belt-like sheets of aluminum are fixed horizontally to the inner surfaces of the side plates (b). Triangular members (8) are adhered and fixed to the lower fixing parts. Furthermore, engaging receptacles (10) used for fitting and engaging the engaging parts (9) of the above-mentioned fixing units are illustrated in FIG. 9. The engaging receptacles (10) of a preferred embodiment include a longitudinal hole in which the engaging part (9) is fitted and engaged. The holes as illustrated in FIG. 12, are located in a central part of the above-mentioned belt-like plate in a properly spaced-apart relation.

The leaf springs (1) which are installed between the right and left supporting parts (7) have a longitudinal plate having a length which is approximately the same as the width of the base of the bed (b). Connectors 5 are connected to both ends of the plate.

The connectors (5) may be made of synthetic resin, steel plate or aluminum or similar material and formed into a tubular shape with a longitudinal section which is to be fitted to the ends of the leaf springs (1) of the present invention, with one end thereof being closed and the other end being formed with fitting parts. The upper and lower surfaces of the connectors (5) are bent inwardly and made such that the end parts are held and supported from above and below when the end parts of the leaf springs (1) are inserted into the fitting parts, with the engaging parts (9) integrally projecting at the lower surface of the connector. The engaging parts (9) are arranged near the lower fitting parts of the connectors (5), with some transverse extending pieces arranged upstanding in a properly spaced-apart relation along the side ends of the fitting parts, and with an engaging projection piece being formed at the extremity end of the fitting piece.

The leaf springs (1) of the present invention are bridged over the right and left supporting parts (7) with the engaging parts (9) of connectors (5) at both ends fitted to and engaged with the longitudinal holes 7, which function as engaging receptacles (10). When the engaging parts (9) are pushed intos the longitudinal holes 7, the pieces are flexed inwardly and upon insertion they are returned to their original condition, with the engaging projection pieces at their ends being engaged with the back surfaces of the engaging receptacles (10).

The leaf springs (1) are arranged in sequence and in parallel between the engaging receptacles (10) for the right and left supporting parts (7) so as to form a floor having a dampening function.

Figure 28:
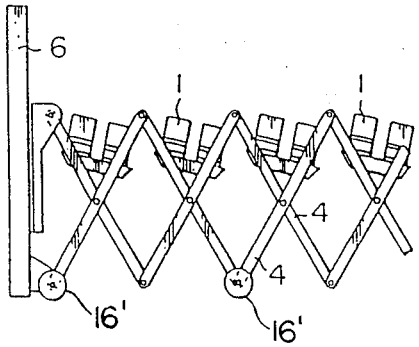
Figure 29:
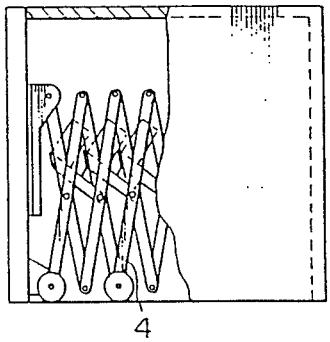

The base of bed (b') may be foldable as shown in FIGS. 26 to 29. In the case of a foldable bed, the base of bed (b') is made such that the central portions are made of longitudinal steel plates (11) which are connected by pivotable screws (12) to make a cross-shaped form. Several cross-shaped longitudinal steel plate structures are connected together to make expandable and retractable right and left side frames. End frames (13) are arranged between both ends of the above right and left side frames. Supporting pieces (14) having engaging receptacles at their upper surfaces are connected to the upper connected portions of connected parts of cross-shaped longitudinal plates (11). The above-mentioned engaging receptacles are placed in a properly spaced apart relation along the upper right and left sides of the base of bed (b'). Leaf springs (1) similar to those above are arranged in parallel fashion between the right and left engaging receptacles. When the base of bed (b') is folded, the lock part 15 installed at the side frame is released and the base of bed is retracted between its forward and rearward positions on rollers 16. As illustrated in FIGS. 28 and 29, the foldable bed may be mounted as part of a cabinet 6, with the longitudinal steel plates 4 permitting the retraction of the bed on rollers 16, and ends of the foldable bed being mounted to inner surfaces of the cabinet and its lid.

Figure 30:
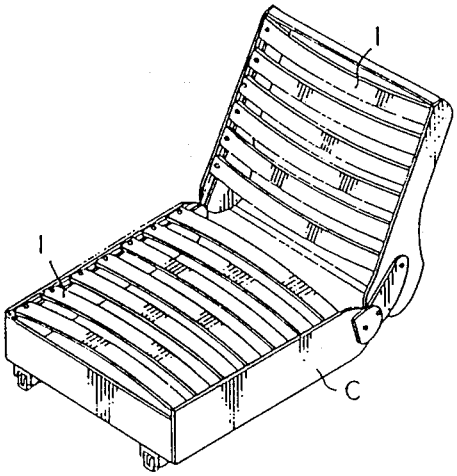
FIGS. 30 and 31 are views showing a condition in which the leaf spring of the present invention is utilized in a chair.
Figure 31:
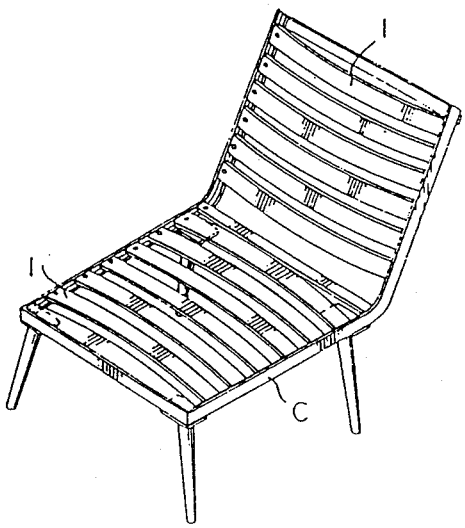

An example in which the leaf spring of the present invention is in a chair will be described in reference to FIGS. 30 and 31, wherein the leaf springs (1) of the present invention are properly spaced apart in the chair frame (c).

The present invention will now be described with reference to a single element and a sandwiched structure each having a uniform thickness.

I. Single element with a uniform thickness and projected shape:

(1) Calculation of a radius of curvature

From the equation 3, it becomes as follows:

$$R = \frac{1}{2H}[l^2/4 + H^2]$$

(2) Calclulation of bending

From equation 7, the amount of bending is expressed as follows:

$$\begin{aligned} Y(i) &= -\sqrt{R^2 - (X(i) - a)^2 + b} \\ &= -\sqrt{[1/2H[l^2/4 + H^2]]^2 - [l/2n\, x\, i - l/2]^2 + 1/2H[l^2/4 + H^2] - H} \\ Y(i) &= -Y(i) \end{aligned}$$

(3) Second moment of area

From the equation 9, it is calculated as follows:

$$Di = \frac{P}{48E_{Yi}}\, 3l^2Xi - 4X^3i$$

However, the present point to be calculated relates to a sinking amount of 2.5 cm at the central part (l/2), so that the calculation for i=n is sufficient for this case.

No correction is required for the second moment of area.

(4) Resolution of second moment of area

Non-required: Due to its simple member, i.e., a sandwiched structure is not being used.

(5) Calculation of plate thickness $$\begin{aligned} I &= 1/12\, bt^2 \\ & \quad I\text{: second moment of area} \\ & \quad b\text{: width of leaf spring} \\ & \quad t\text{: plate thickness} \\ 12I &= bt^3 \\ 12I/b &= t^3 \\ \text{therefore } t &= \sqrt[3]{12I/b} \end{aligned}$$

Substituting I with Di as calculated in (3) above the plate thickness is determined.

(6) Calculation of flexure

Flexure at each of the portions is calculated by the following equation:

$$YYi = \frac{P}{48E_sD_i}(3\, l^3Xi - 4Xi^3)$$

Assuming a flexure of YYi, this can be expressed as follows:

$$\begin{aligned} YYi &= \text{Bending width } i - \text{flexure } i \\ &= Y(i) - YY(i) \end{aligned}$$

II. Sandwicheed structure with uniform thickness and projected shape (1) Calculation of a radius of curvature From equation 3, the radius of curvature is expressed as follows:

$$R = \tfrac{1}{2}H[l^2/4 + H^2]$$

(2) Calculation of bending

From equation 7, bending is calculated as follows:

$$\begin{aligned} Y(i) &= -\sqrt{R^2 - (X(i) - a)^2 + b} \\ &= -\sqrt{1/2H[l^2/4 + H^2]]^2 - [l/2n\, Xi - l/2]^2 + 1/2H[l/4 + H^2] - H} \\ Y(i) &= -Y(i) \end{aligned}$$

(3) Second moment of area $$Di = \frac{P}{48E_sY}[3l^2Xi - 4X^3i]$$

The reason the position of l/2 is used in the above calculation is due to the fact that the calculation of the second moment of area, other than at the central position, is not needed because of the assumption that a sinking of 2.5 cm with 13.5 kg occurs only at the central part of /2.

(4) Resolution of second moment of area

When considering a sandwiched structure, it is necessary to resolve the second moment of area. In a case of non-uniform thickness, the calculation is performed for each of the portions. Moreover, in this case the calculation only at the central part (l/2) is sufficient.

(a) Second moment of area of surface material is calculated using equation (19).

(b) Second moment of area of core member is calculated using equation (13).

$$I_E = b/12E_c/E_s(TT-2T)^3$$

(c) Second moment of area $I_T$ of leaf spring is calculated by $$I_T = I_E + I_S$$

An example of this value corresponds to case 4 indicated in the table 4 below.

TABLE 4

| | (The position of center line when it is loaded (unit:mm)) | | | | |
|---|---|---|---|---|---|
| | Calculated thickness | | | | |
| No. | Max 13.1 Case No. 1 FRP + distance (mm) | Max. 13.4 Case No. 2 FRP + uneven thickness | Max 10.3 Case No. 3 FRP + uneven thickness | 13.10 Case No. 4 FRP + uneven thickness | 8.05 Case No. 5 FRP even thickness |
| 1 | 0.0 | 0.0 | 0.0 | 0.0 | 0.0 |
| 2 | 37.9 | 0.0 | 0.0 | 0.0 | 0.9 |
| 3 | 75.8 | 0.1 | 0.0 | 0.1 | 1.4 |
| 4 | 113.7 | 0.1 | 0.1 | 0.0 | 1.8 |
| 5 | 151.6 | 0.0 | 0.0 | 0.1 | 1.9 |
| 6 | 189.5 | 0.0 | 0.0 | 0.1 | 1.8 |
| 7 | 227.5 | 0.0 | 0.0 | 0.1 | 1.6 |
| 8 | 265.4 | 0.1 | 0.0 | 0.1 | 1.3 |
| 9 | 303.3 | 0.1 | 0.1 | 0.0 | 1.0 |
| 10 | 341.2 | 0.0 | 0.0 | 0.2 | 0.7 |
| 11 | 379.1 | 0.1 | 0.1 | 0.2 | 0.4 |
| 12 | 417.0 | 0.1 | 0.1 | 0.3 | 0.1 |
| 13 | 455.0 | 0.1 | 0.2 | 0.2 | 0.0 |

A first embodiment of the present invention is a leaf spring in which a plate member has a thickness of about 5 to 20 mm, a width of about 20 to 200 mm and a proper length with a resiliency such that the same bent and curved at a central height of 20 to 40 mm and to hold a substantially horizontal condition under a load of 5 to 30 kg, and in which the plate member is not broken under a load of 50 to 100 kg. In this manner, if utilized as a spring member in a chair or bed, the spring will not be broken even if the weight of an average 50 to 100 kg person is applied to the spring. Nevertheless, a horizontal position will be maintained which enables a variety of applications. In case of making a longitudinal element, the plate may be extended as required for its intended purpose.

A second embodiment of the present invention utilizes the major component of the first invention. In this embodiment of the invention the plate thickness is made non-uniform and the leaf spring is designed to hold its horizontal position when a load is applied to it so as to achieve all of the effects of the first invention. In this embodiment, it is preferred that the leaf spring comprise a plate having first and second ends and a thickness of between approximately 5 mm and 6 mm at each of the first and second ends. The central portion has a thickness of approximately 20 mm, whereby the plate has a non-uniform thickness throughout. Additionally, the plate has a length of approximately 100 cm.

More specifically, the plate may have an upper surface, a lower surface, and a width of approximately 50 mm, with the plate being deformed in an arcuate configuration having a height at the central portion of approximately 25 mm. The leaf spring may also include a reinforcing fiber reinforced plastic layer of between approximately 0.5 mm and 0.8 thickness on the upper surface and the lower surface of the core member.

A third embodiment of the present invention provides a useful leaf spring for obtaining a comfortable sleeping condition.

A fourth embodiment of the present invention consists in a practical invention in which a reinforcing member is used for executing the first and second embodiments of inventions.

A fifth embodiment of the present invention is an invention in which the reinforcing member of the fourth embodiment is more practically constructed.

A sixth embodiment of the present invention is an invention in which the first to fourth embodiments are utilized in a Japanese mattress to provide a rational or natural sleeping attitude.

A seventh embodiment of the present invention is an invention in which the first to fifth embodiments are utilized in a bed in which a rational or natural sleeping attitude can be attained.

An eighth embodiment of the present invention is a useful invention in which the first to fifth embodiments are used in a frame so as to form a bed.

A ninth embodiment of the present invention relates to a bedding material in which a sponge material is used in conjunction with the first to fifth embodiments so as to improve the cushioning characteristic thereof.

A tenth embodiment of the present invention relates to the structures of the first to fifth embodiments having an effect more similar to that of the fifth embodiment.

An eleventh embodiment of the present invention is an invention in which the most useful characteristic of the present invention is attained.

Figure 5:
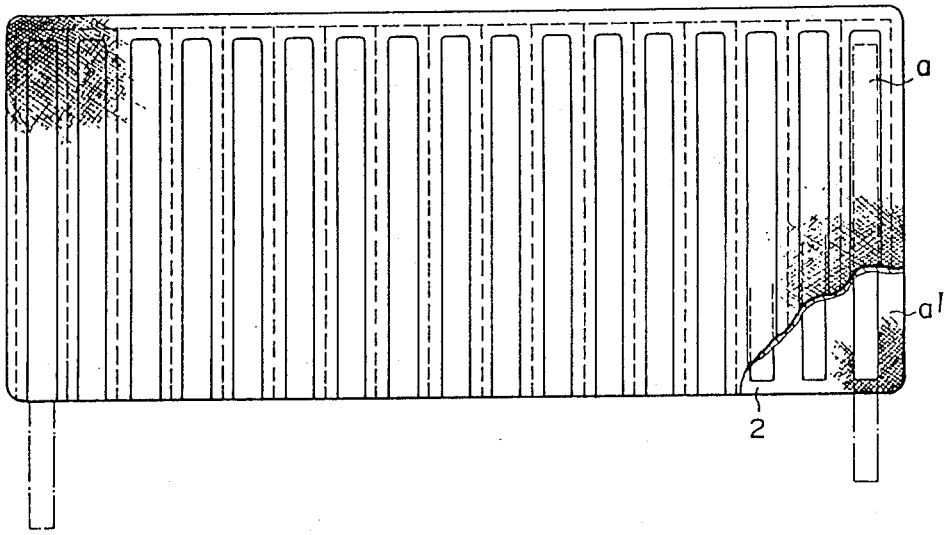
FIGS. 5 to 6 are a top plan view and a longitudinal front elevational view in section of a Japanese style mattress having the leaf spring of the present invention utilized therein, respectively.
Figure 6:
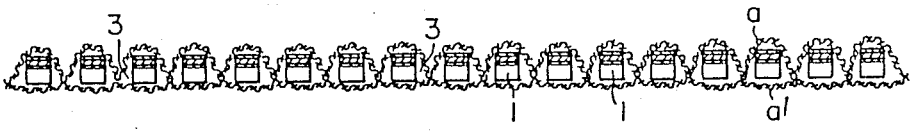
Figure 7:
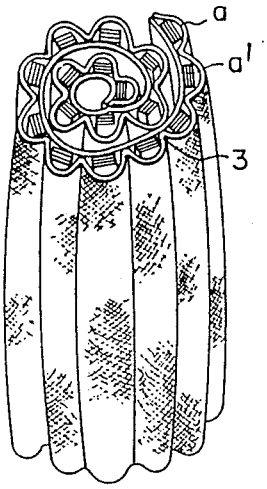
FIG. 7 is a perspective view showing a condition in which the Japanese style mattress is stored.
Figure 8:
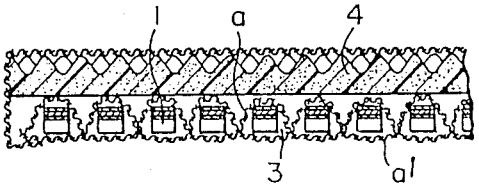
FIG. 8 illustrates a condition in which urethane sponge having a corrugated surface is applied to the system shown in FIG. 6.
Figure 11:
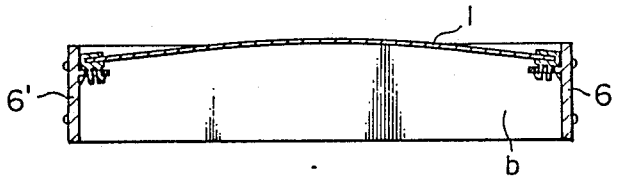

As indicated in the sixth embodiment, when the leaf spring is utilized in a Japanese mattress, as shown in FIGS. 5 to 7, a proper number of storing compartments are made in a suitable cloth member and the leaf springs are stored therein. In the seventh embodiment, as illustrated in FIGS. 28–29, two supporting rods (4) are made in an X-shaped form to be opened or closed. Several pairs of these rods are connected to each other so as to form an expandable or retractable support. Two rod support units are utilized with one end of each of the rods support units being fixed to the inner surface 6 of a cabinet having an opening at one side thereof. The other end of the rod support units is fixed to the inner surface of the lid to close the opening of the cabinet. The bed assembly in this embodiment has proper number of leaf springs which are attached to the rod support units to form a bed. The space between the leaf springs, corresponds to the width of the leaf spring.

In the eighth embodiment invention the leaf spring is utilized for a Japanese type room. As shown in FIGS. 9 to 10, several leaf springs are mounted in a frame having length approximately equal to the height of a human. In the ninth embodiment, a corrugated sponge layer of urethane foam is placed on the leaf springs to enable the assembly to be utilized as a bed or a Japanese mattress.

It is apparent that the strength of the leaf spring utilized here corresponds to the value found in a rational or natural sleeping attitude. Further it is apparent that the leaf spring of the present invention may be utilized by applying weight loads less than those that will cause the springs to break. Safe value for a substantial load can be applied.

FIG. 13 illustrates a rational or natural sleeping attitude in which the leaf spring of the present invention is used in a Japanese style room bed. In this example the leaf spring may assume a rational or natural sleeping attitude when being utilized in a Japanese style mattress or bed.

Although the invention has been described with reference to particular means, materials and embodiments, from the foregoing description, one skilled in the art can easily ascertain the essential characteristics of the present invention, and various changes and modifications may be made to adapt to various usages and conditions, without departing from the spirit and scope of the invention as described in the claims that follow.

What is claimed is:

1. A leaf comprising a plate member having a thickness of between approximately 5 mm and 20 mm and a width of between approximately 20 mm and 200 mm, said plate member having a given length and being arcuately deformed so that it includes a central portion, a first end and a second end with a height of said central portion above a plane passing through said first end and said second end being between about 20 mm and 40 mm; said plate comprising means for providing a predetermined resiliency for maintaining the plate member in a substantially horizontal position under a load of between 5 kg and 30 kg, and for preventing said plate member from breaking under a load of between 50 kg and 100 kg; and said plate member comprising first and second layers made of glass-fiber or carbon-fiber and a core member made of a polyurethane foam material, with said core member being positioned between said first and second layers.

2. The leaf spring in accordance with claim 1, wherein said polyurethane foam material has a density of between approximately 35 kg/m$^3$ and 45 Kg/m$^3$.

3. The leaf spring in accordance with claim 2, wherein said polyurethane foam material has a density of approximately 35 Kg/m$^3$.

4. The leaf spring in accordance with claim 2, wherein said polyurethane foam material has a density of approximately 45 Kg/m$^3$.

5. The leaf spring in accordance with claim 1, having a thickness of between approximately 5 mm and 6 mm at each of said first end and said second end; said central portion having a thickness of approximately 20 mm; said plate member thus having a non-uniform thickness throughout; and said plate further having a length of approximately 100 cm.

6. The leaf spring in accordance with claim 1, wherein said first and second layers are made from glass-fiber.

7. The leaf spring in accordance with claim 6, wherein said glass-fiber has an elastic modulus of between approximately 3,900 Kg/m$^3$ and 4,480 Kg/m$^3$.

8. The leaf spring in accordance with claim 7, wherein said glass-fiber has an elastic modulus of approximately 3,900 Kg/m$^3$.

9. The leaf spring in accordance with claim 7, wherein said glass-fiber has an elastic modulus of approximately 4,480 Kg/m$^3$.

10. The leaf spring in accordance with claim 6, wherein said glass-fiber has an elastic modulus of between approximately 3,900 Kg/m$^3$ and 4,480 Kg/m$^3$, and said core comprises a polyurethane foam material having a density of between approximately 35 Kg/m$^3$ and 45 Kg/m$^3$.

11. The leaf spring in accordance with claim 10, wherein said glass-fiber has an elastic modulus of approximately 3,900 Kg/m$^3$.

12. The leaf spring in accordance with claim 10, wherein said glass-fiber has an elastic modulus of approximately 4,480 Kg/m$^3$.

13. The leaf spring in accordance with claim 10, wherein said polyurethane foam material has a density of approximately 35 Kg/m$^3$.

14. The leaf spring in accordance with claim 10, wherein said polyurethane foam material has a density of approximately 45 Kg/m$^3$.

15. The leaf spring in accordance with claim 1, wherein said first and second layers comprise carbon-fiber.

16. The leaf spring in accordance with claim 15, wherein said carbon-fiber has an elastic modulus of between approximately 10,000 Kg/m$^3$, and said polyurethane foam material has a density of between approximately 35 Kg/m$^3$ and 45 Kg/m$^3$.

17. The leaf spring in accordance with claim 16, wherein said polyurethane foam material has a density of approximately 35 Kg/m$^3$.

18. The leaf spring in accordance with claim 16, wherein said polyurethane foam material has a density of approximately 45 Kg/m$^3$.

19. A leaf spring comprising a plate having a first end, a second end, and a central portion; said plate having a width of approximately 50 mm and a length of approximately 910 mm, said first end and said second end each having a thickness of between approximately 5 mm and 6 mm and said central portion having a thickness of about 20 mm; said plate comprising a core member having an upper surface and a lower surface, with said core member being arcuate in configuration and said central portion having a height of approximately 25 mm with respect to a plane passing through said first end and said second end; a thin reinforcing member covering at least one of said upper surface and said lower surface of said plate; and said plate comprising means for providing a predetermined resiliency for maintaining said plate in a substantially horizontal position under a load of between 5 kg and 30 kg, and further comprising means for preventing said plate from breaking under a load of between 50 kg and 100 kg.

20. The leaf spring in accordance with claim 19, wherein both said upper surface and aid lower surface are covered with a thin reinforcing member, and a heat-shrink synthetic resin film covers said reinforcing members.

21. A leaf spring comprising a plate member in the form of a core having first and second ends of a thickness of between approximately 5 mm and 6 mm; said plate member further having a thickness of approximately 20 mm at a central portion thereof, said plate member therefore having a non-uniform thickness; said plate member having an upper surface, a lower surface, and a width of approximately 50 mm; said plate member having an arcuate configuration with a height at said centrl portion of approximately 25 mm with respect to a plane passing through said first and second ends; said plate member further comprising a fiber reinforced plastic layer of between approximately 0.5 mm and 0.8 mm thickness on said upper surface and said lower surface of said core; said core comprising a polyurethane foam material; and said plate member comprising means for providing a predetermined resiliency for maintaining said plate member in a substantially horizontal position under a load ranging between 5 kg and 30 kg, and for preventing said plate member from breaking under a load of between 50 kg and 100 kg.

22. A mattress support comprising a plurality of spaced-apart leaf springs covered by a cloth, each of said leaf springs comprising a plate member having a thickness of between approximately 5 mm and 20 mm, a width of between approximately 20 mm and 200 mmm, and a length of approximately 100 cm, each of said plate members having an arcuate configuration having a central portion, a first end and a second end, with said central portion having a height of between about 20 mm and 40 mm; and said plate member comprising means for providing a predetermined resiliency for permitting each plate member to bend into a substantially horizontal position under a load of between 5 kg and 30 kg and for preventing each plate member from breaking under a load of between 50 kg and 100 kg, wherein said mattress support comprises means for supporting a human body at an attitude similar to a normal standing position for said human body.

23. The mattress support in accordance with claim 22, wherein a corrugated sponge is positioned above said plurality of spaced-apart leaf springs and below said cloth.

24. The mattress support in accordance with claim 22, wherein each of said plate members comprises an upper surface, a lower surface, and reinforcing members are adhered to each of said upper surface and said lower surface.

25. A bed assembly comprising a cabinet and a plurality of spaced leaf springs; each of said plurality of spaced leaf springs comprising a plate member having a thickness of approximately between 5 mm and 20 mm, a width of between approximately 20 mm to 200 mm, and a length of approximately 100 cm; said plate member having first and second ends, and a generally arcuate shape; said plate member having a central portion with a height of between approximately 20 mm and 40 mm with respect to a plane passing through said first and second ends; said plate member comprising means for providing a predetermined resiliency for permitting said plate member to assume a substantially horizontal position when subjected to a load of between 5 kg and 30 kg and for preventing said plate member from being broken under a load of between 50 kg and 100 kg; and said bed further comprising a plurality of support leg assemblies, with said plurality of leaf springs being capable of supporting a human body at an attitude similar to a normal standing position of said human body, and said leaf springs being attached to said plurality of support leg assemblies.

26. The bed in accordance with claim 25 wherein each of said plurality of support leg assemblies comprise a plurality of connected support rod pairs, the rods in each pair being connected to each other in a pivotable fashion so as to form a selectively openable X-shape, with said support rod pairs thereby being mounted to expand and retract; one end of each of said plurality of support leg assemblies being attached to an inner surface of a cabinet, and a second end of each said plurality of support leg assemblies being attached to an inner surface of a lid adapted to close said cabinet; and said leaf springs being mounted over and attached in parallel to said plurality of support leg assemblies in a predetermined spaced-apart relationship.

27. The bed assembly in accordance with claim 26, further comprising a plurality of rollers located at lower portions of said plurality of support leg assemblies to facilitate expansion and contraction of the bed assembly.

28. A leaf spring comprising a plate having a first end, a second end, and a central portion; said plate having a width of approximately 50 mm and a length of approximately 910 mm, said first end and said second end each having a thickness of between approximately 5 mm and 6 mm, and said central portion having a thickness of about 20 mm; said plate comprising a core member having an upper surface and a lower surface, with said core member having an arcuate configuration; said plate further comprising a thin reinforcing member covering at least one of said upper surface and said lower surface of said plate; and said plate comprising means for providing a predetermined resiliency for maintaining said plate in a substantially horizontal position under a load of between 5 kg and 30 kg, and for preventing said plate from breaking under a load of between 50 kg and 100 kg.

* * * * *